US010954897B2

(12) United States Patent
Malvasi et al.

(10) Patent No.: US 10,954,897 B2
(45) Date of Patent: Mar. 23, 2021

(54) AUTOMOTIVE VAPOR PUMP

(71) Applicant: PIERBURG PUMP TECHNOLOGY GMBH, Neuss (DE)

(72) Inventors: Alessandro Malvasi, Leghorn (IT); Andreas Wulf, Duesseldorf (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 427 days.

(21) Appl. No.: 15/776,078

(22) PCT Filed: Nov. 16, 2015

(86) PCT No.: PCT/EP2015/076706
§ 371 (c)(1),
(2) Date: May 15, 2018

(87) PCT Pub. No.: WO2017/084694
PCT Pub. Date: May 26, 2017

(65) Prior Publication Data

US 2020/0256285 A1 Aug. 13, 2020

(51) Int. Cl.
*F02M 25/08* (2006.01)
*F02D 41/00* (2006.01)
*F04D 25/06* (2006.01)

(52) U.S. Cl.
CPC ..... *F02M 25/089* (2013.01); *F02M 25/0809* (2013.01); *F02D 41/004* (2013.01); *F02D 2200/0406* (2013.01); *F02M 25/0854* (2013.01); *F02M 2025/0845* (2013.01); *F04D 25/0666* (2013.01); *F05D 2270/3013* (2013.01)

(58) Field of Classification Search
CPC ..... F02M 21/0218; F02M 25/08; F02M 25/0836; F02M 37/04; F02M 37/08; F02M 37/14
See application file for complete search history.

(56) References Cited

U.S. PATENT DOCUMENTS 5,120,201 A 6/1992 Tuckey et al.
5,817,925 A 10/1998 Cook et al.
(Continued)

FOREIGN PATENT DOCUMENTS

CN 1360145 A 7/2002
GB 2487250 A 7/2012
JP 2007-154753 A 6/2007

*Primary Examiner* — Sizo B Vilakazi
*Assistant Examiner* — Anthony L Bacon
(74) *Attorney, Agent, or Firm* — Norman B. Thot

(57) ABSTRACT

An automotive vapor pump for pumping a pump gas having a fuel vapor. The automotive vapor pump includes a pump inlet opening, a pump outlet opening, an outlet volute, a pump outlet duct which is substantially tangential and which fluidically connects the outlet volute with the pump outlet opening, a centrifugal pumping wheel which pumps the pump gas from the pump inlet opening into the outlet volute and subsequently into the pump outlet duct, an electric motor which drives a pumping wheel, the electric motor including a static motor coil, a magnetic rotor body, and a motor driving electronics which drives the static motor coil, an electric connector plug which electrically connects the motor driving electronics with an external control unit, and an integrated pressure sensor which detects a fluidic pressure in the outlet volute or in the pump outlet duct.

11 Claims, 5 Drawing Sheets

(56) References Cited

U.S. PATENT DOCUMENTS

| | | | | |
|---|---|---|---|---|
| 6,036,456 | A | 3/2000 | Peters et al. | |
| 2002/0081211 | A1 | 6/2002 | Benghezal et al. | |
| 2003/0047008 | A1* | 3/2003 | Gopalakrishnan | G01F 1/05 73/861.79 |
| 2003/0223877 | A1 | 12/2003 | Anstine et al. | |
| 2005/0139197 | A1 | 6/2005 | Ohhashi et al. | |
| 2012/0213627 | A1 | 8/2012 | Carter et al. | |
| 2014/0096749 | A1* | 4/2014 | Pearce | F02M 25/0854 123/520 |
| 2015/0285170 | A1* | 10/2015 | Nanba | F02D 41/004 123/520 |

* cited by examiner

AUTOMOTIVE VAPOR PUMP

CROSS REFERENCE TO PRIOR APPLICATIONS

This application is a U.S. National Phase application under 35 U.S.C. § 371 of International Application No. PCT/EP2015/076706, filed on Nov. 16, 2015. The International Application was published in English on May 26, 2017 as WO 2017/084694 A1 under PCT Article 21(2).

FIELD

The present invention relates to an automotive vapor pump, for example, to a purge pump for pumping a pump gas comprising fuel vapor.

BACKGROUND

In an automotive application, an electric vapor pump is used, among others, as a part of an automotive vapor pump arrangement for pumping pump gas comprising fuel vapor from a vapor absorption unit to a vapor target, for example, to the intake section of an internal combustion engine. An example of a typical automotive fuel vapor pump arrangement is described in US 2015/0285170 A1.

Since automotive fuels and fuel vapors are corrosive, the use of a canned electric motor to drive a pumping wheel of the electric vapor pump is preferred. The electric motor is therefore brushless and electronically driven. The electric motor should be provided as simply and inexpensively as possible. It is therefore preferred that no separate Hall sensor be used to detect the correct rotational direction and function of the electric motor. It is nonetheless desirable to reliably detect the correct function of the electric motor because environmental provisions could be infringed if the vapor pump fails.

SUMMARY

An aspect of the present invention is to provide a simple automotive vapor pump for an automotive vapor pump arrangement which provides for a reliable control of the pump's functionality.

In an embodiment, the present invention provides an automotive vapor pump for pumping a pump gas comprising a fuel vapor. The automotive vapor pump includes a pump inlet opening, a pump outlet opening, an outlet volute, a pump outlet duct configured to be substantially tangential and to fluidically connect the outlet volute with the pump outlet opening, a centrifugal pumping wheel configured to pump the pump gas from the pump inlet opening into the outlet volute and subsequently into the pump outlet duct, a pumping wheel, an electric motor configured to drive the pumping wheel, the electric motor comprising at least one static motor coil, a magnetic rotor body, and a motor driving electronics which is configured to drive the at least one static motor coil, an electric connector plug configured to electrically connect the motor driving electronics with an external control unit, and an integrated pressure sensor configured to detect a fluidic pressure in the outlet volute or in the pump outlet duct.

BRIEF DESCRIPTION OF THE DRAWINGS

The present invention is described in greater detail below on the basis of embodiments and of the drawings in which.

DETAILED DESCRIPTION

Figure 1:
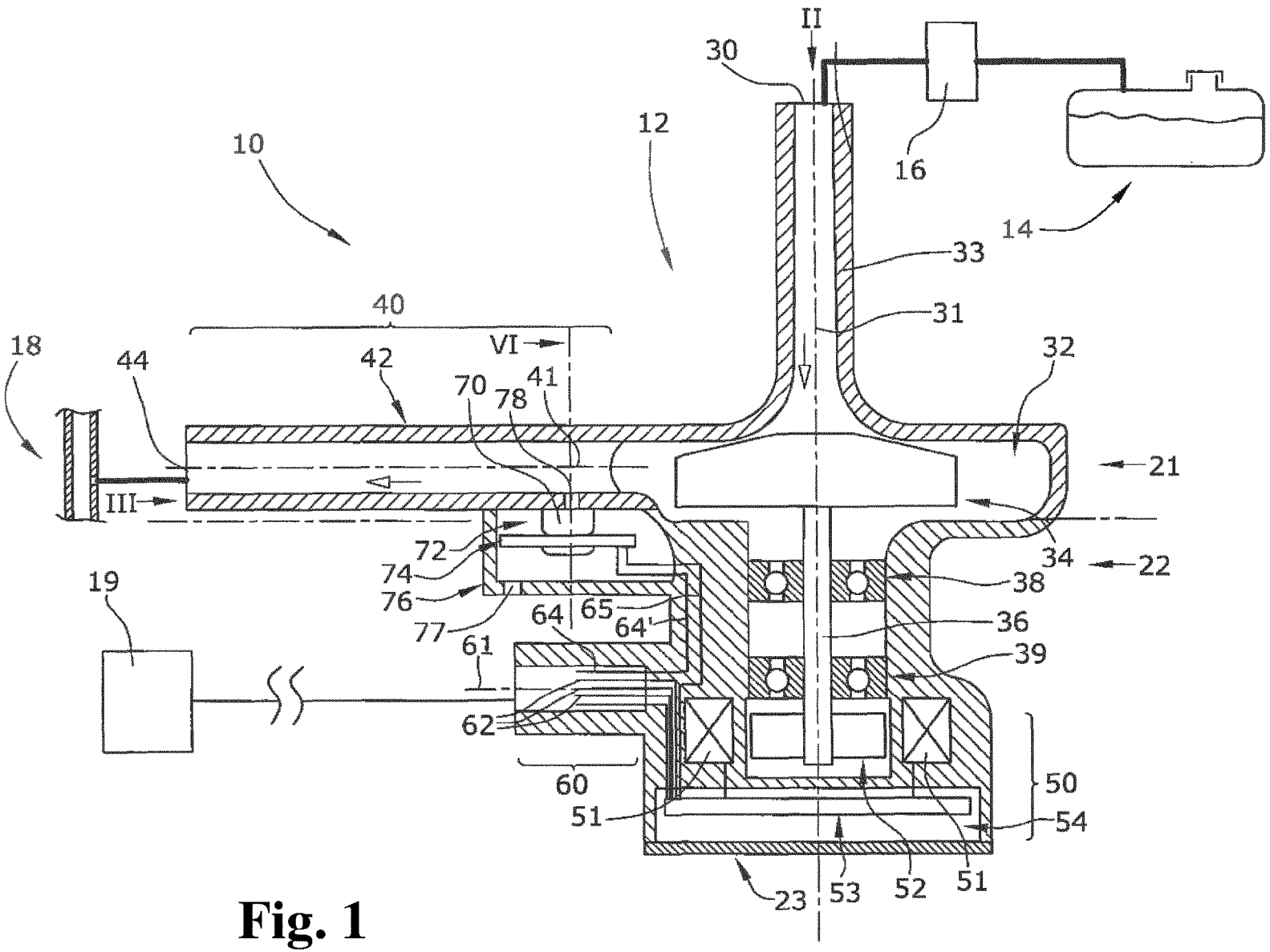
FIG. 1 schematically shows an automotive vapor pump arrangement comprising a vapor pump in a longitudinal cross section.

The automotive vapor pump according to the present invention comprises a centrifugal pumping wheel for pumping the pump gas from a pump inlet opening to an outlet volute, and subsequently into a substantially tangential pump outlet duct which fluidically connects the outlet volute with a pump outlet opening. The pump is a flow type pump. The pump wheel is driven by an electric motor which comprises at least one static motor coil, a magnetic motor rotor body, and a motor driving electronics for driving the motor coil. The electric motor is a brushless motor.

In an embodiment of the present invention, the electric motor can, for example, be a canned motor and/or a sensorless motor. The concept of the pump motor as a canned motor allows gas/vapor to be hermetically isolated from the motor driving electronics and the static electromagnetic coil so that a high level of electrical reliability can be realized.

"Sensorless" means that no separate position sensor is provided to detect the motor rotor position so that expenses for a position sensor can be saved. No absolute reliable detection of the correct rotational direction, speed etc. of the electric motor can therefore be provided.

The vapor pump is provided with an electric connector plug for electrically and electronically connecting the motor driving electronics with an external control unit which can be a part of the engine control unit (ECU) which also controls the internal combustion engine.

The automotive vapor pump is provided with an integrated pressure sensor detecting the fluidic pressure in the outlet volute or in the pump outlet duct. The pressure sensor can, for example, be provided at the pump outlet duct between the outlet volute and the pump outlet opening. The pressure sensor is integrated into the vapor pump so that no separate pressure sensor needs to be provided between the vapor pump and the vapor target downstream of the vapor pump.

The integrated pressure sensor can provide information about the general functionality of the vapor pump and can also provide information about the absolute and/or relative fluidic pressure downstream of the pumping wheel. After the vapor pump has been electrically activated by an external control unit, the integrated pressure sensor allows for an immediate control if the pump wheel rotates into the correct rotational direction. Since the pressure sensor is provided and located very close to the pumping wheel, namely less than 50 mm, a close causal and real-time relationship exists between the electric motor's activity and the detected fluidic pressure profile.

In an embodiment of the present invention, the electric connector plug and the pressure sensor axially can, for example, overlap with each other at least in part. In other words, the pressure sensor and the electric connector plug have a similar or the same orientation with respect to the rotational axis of the motor and the pumping wheel. The pressure sensor and the electric connector lie within the same rotational sector of 60° with respect to the rotational pump axis. The axial distance of the pressure sensor and the electric connector plug can, for example, be relatively small, for example, less than one third of the complete axial length between the distal end of the pump wheel and the distal end of the electric motor including motor driving electronics. The pressure sensor is therefore located very close to the electric connector plug.

In an embodiment of the present invention, the pressure sensor can, for example, be electrically directly connected to a contact pin of the electric connector plug via an integrated electric line. The electric connection line between the pressure sensor and the electric plug is very short so that the relatively low electric signal generated by the pressure sensor can be reliably transferred to the external control unit. This feature is highly relevant if the electric signal provided by the pressure sensor is used in an external control unit to control the functionality of the vapor pump.

In an embodiment of the present invention, the pump outlet duct and the electric connector plug can, for example, axially overlap with each other. This means that the pump outlet duct and the electric connector plug have a similar or the same orientation with respect to the rotational axis of the pump rotor. The pump outlet duct and the electric connector plug both lie within the same sector of 60° with respect to the rotational pump axis. The silhouette of the pump as seen in the axial direction is therefore relatively compact.

In an embodiment of the present invention, the pump housing can, for example, be defined by a fluid housing part defining the pump inlet opening and the pump outlet duct and by a separate motor housing part comprising the electric motor and the pressure sensor.

In an embodiment of the present invention, a sensor chamber comprising the pressure sensor can, for example, be arranged axially between the pump outlet duct and the electric connector plug. The sensor chamber is therefore arranged axially as close as possible to the electric connector plug.

In an embodiment of the present invention, the pump outlet duct can, for example, be provided with a sensor opening which fluidically connects the interior of the pump outlet duct with the sensor chamber. The pressure sensor provided within the sensor chamber is fluidically connected to the sensor opening so that the pressure sensor detects the static pressure in the outlet duct.

In an embodiment of the present invention, the sensor opening can, for example, be provided at the fluid housing part, whereas the sensor chamber can, for example, be substantially but not necessarily completely defined by the motor housing part, for example, the pressure chamber is completely defined by both housing parts.

An automotive vapor pump arrangement according to the present invention comprises a fuel tank, a vapor absorption unit, and an automotive vapor pump for pumping the vapor to a vapor target. The automotive vapor pump is fluidically arranged between the vapor absorption unit and the vapor target.

In an embodiment of the present invention, the vapor target can, for example, be an intake section of an internal combustion engine. In this arrangement, the vapor pump is a so-called purge pump for pumping the fuel vapor from the vapor absorption unit, where a particular amount of fuel vapor can be temporarily absorbed, to the combustion engine's intake section where the fuel vapor is led into the engine to be combusted.

One embodiment of the present invention is described below under reference to the drawings.

FIG. 1 schematically shows an automotive vapor pump arrangement 10 for pumping a pump gas comprising fuel vapor. The vapor pump arrangement 10 comprises an automotive fuel tank 14 which is fluidically connected to a vapor absorption unit 16. The vapor absorption unit 16 can comprise charcoal. The vapor absorption unit 16 is fluidically connected with a pump inlet 30 of an automotive vapor pump 12. A pump outlet 44 of the vapor pump 12 is fluidically connected to a vapor target 18 which is an intake section of an internal combustion engine (not shown in the drawings). The vapor pump 12 is also known as a so-called purge pump.

The vapor pump 12 is designed as a flow pump comprising an impeller-like rotating pumping wheel 34 with an axial gas inlet. The rotating pumping wheel 34 rotates with high rotational speed of between 10000 to 45000 rpm. The pump gas is thereby accelerated and radially flows into an outlet volute 32 from where the pump gas flows into a tangential pump outlet duct 40 with a pump outlet 44 at its distal end. The pressure rise caused by the rotating pumping wheel 34 is in the range 50 and 100 mbar.

The housing of the vapor pump 12 comprises two separate housing parts, namely, a fluid housing part 21 defining an opening of the pump inlet 30 and the outlet duct 40, and a separate motor housing part 22 comprising an electric motor 50, two roller bearings 38, 39, an electric connector plug 60, and substantially defining a sensor chamber 72.

The rotor assembly comprises the rotating pump wheel 34 supported by a rotor shaft 36 which is rotatably supported by the two roller bearings 38, 39 at the motor housing part 22. The rotor shaft 36 also is provided with a permanently magnetized motor rotor 52 which is surrounded by one or more static motor coils 51. The rotor assembly rotates around a rotation axis 31.

The motor housing part 22 also defines a motor electronics chamber 54 which comprises a motor driving electronics 53 for driving the rotor coils. The motor electronics chamber 54 is closed by a separate electronics chamber cover 23.

The fluid housing part 21 defines an axial inlet duct 33 which is axially aligned with the rotating pumping wheel 34 and the rotation axis 31, and also defines an outlet duct 40 which is defined by a tube-like and straight outlet duct wall 42. The outlet duct 40 defines a general outlet duct axis 41.

The motor housing part 22 defines an electric connector plug 60 with a couple of contact pins 62, 64. The electric connector plug 60 has a general plugging axis 61 which is the general direction for connecting or disconnecting a corresponding plug with/from to the electric connector plug 60. The electric connector plug 60 is electrically connected to an external control unit 19 for controlling the vapor pump 12.

The motor housing part 22 also defines a pressure sensor chamber 72 adjacent to the outlet duct 40 and housing a pressure sensor 70. The pressure sensor 70 is fluidically connected via a sensor opening 78 in the outlet duct wall 42 with the interior of the outlet duct 40. The pressure sensor 70 detects the pressure difference between the pressure duct interior and the surrounding atmospheric pressure. The pressure sensor chamber 72 is substantially defined by a pressure chamber wall 76 which is an integral part of the motor housing part 22. The pressure chamber wall 76 is provided with a reference opening 77 which fluidically connects the pressure sensor chamber 72 with atmospheric pressure.

The pressure sensor 70 is electrically and mechanically fixed to a printed circuit board 74 which is electrically connected via an electric line 64' with the contact pin 64 of the electric connector plug 60. The pressure sensor 70 and the printed circuit board 74 are also electrically connected via a separate electric line 65 with the motor driving electronics 53.

Figure 2:
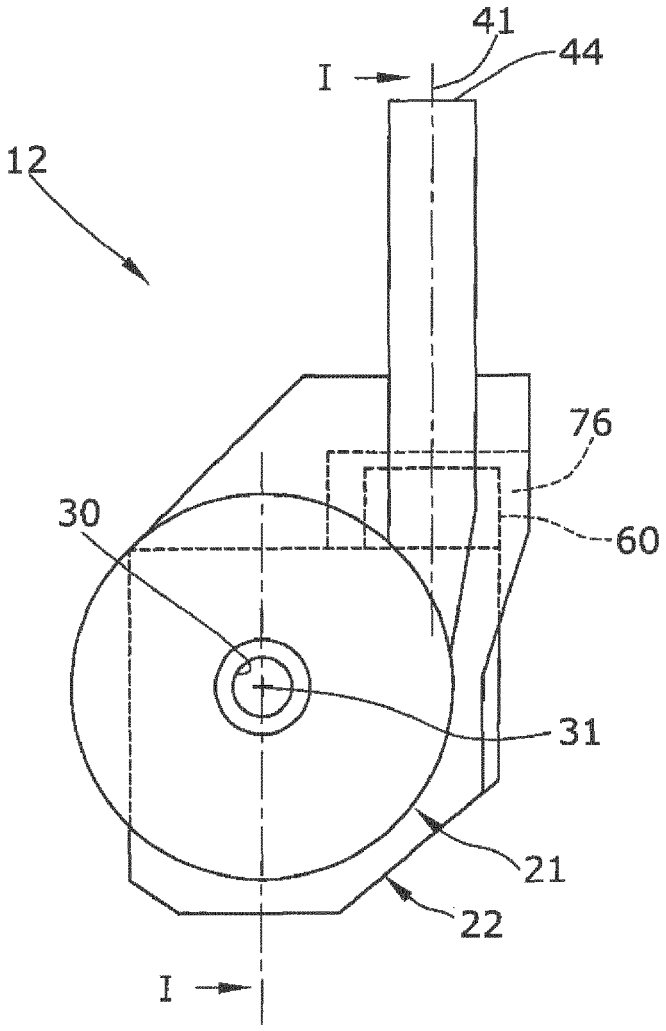
FIG. 2 shows the vapor pump of FIG. 1 in axial direction II from the pump inlet side.
Figure 3:
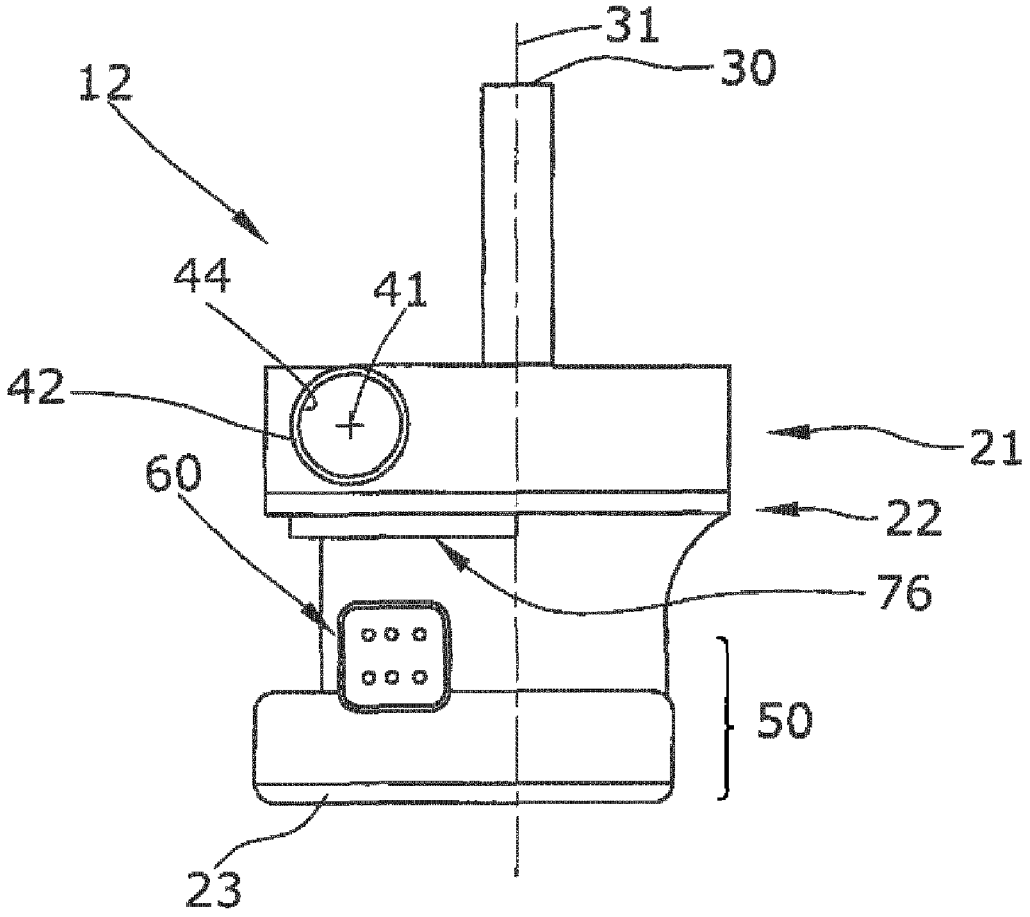
FIG. 3 shows the vapor pump of FIG. 1 in radial direction III from the pump outlet site.

As seen in the axial direction, the outlet duct 40, the electric connector plug 60 and the pressure sensor 70 axially overlap with each other so that these elements are provided in the same sector of about 60° referring to the rotation axis 31. The contour of the vapor pump 12 as seen in the axial direction is therefore relatively compact, as can be seen in FIG. 2.

The pressure sensor 70 and the sensor chamber 72 are axially arranged between the outlet duct 40 and the electric connector plug 60.

Figure 4:
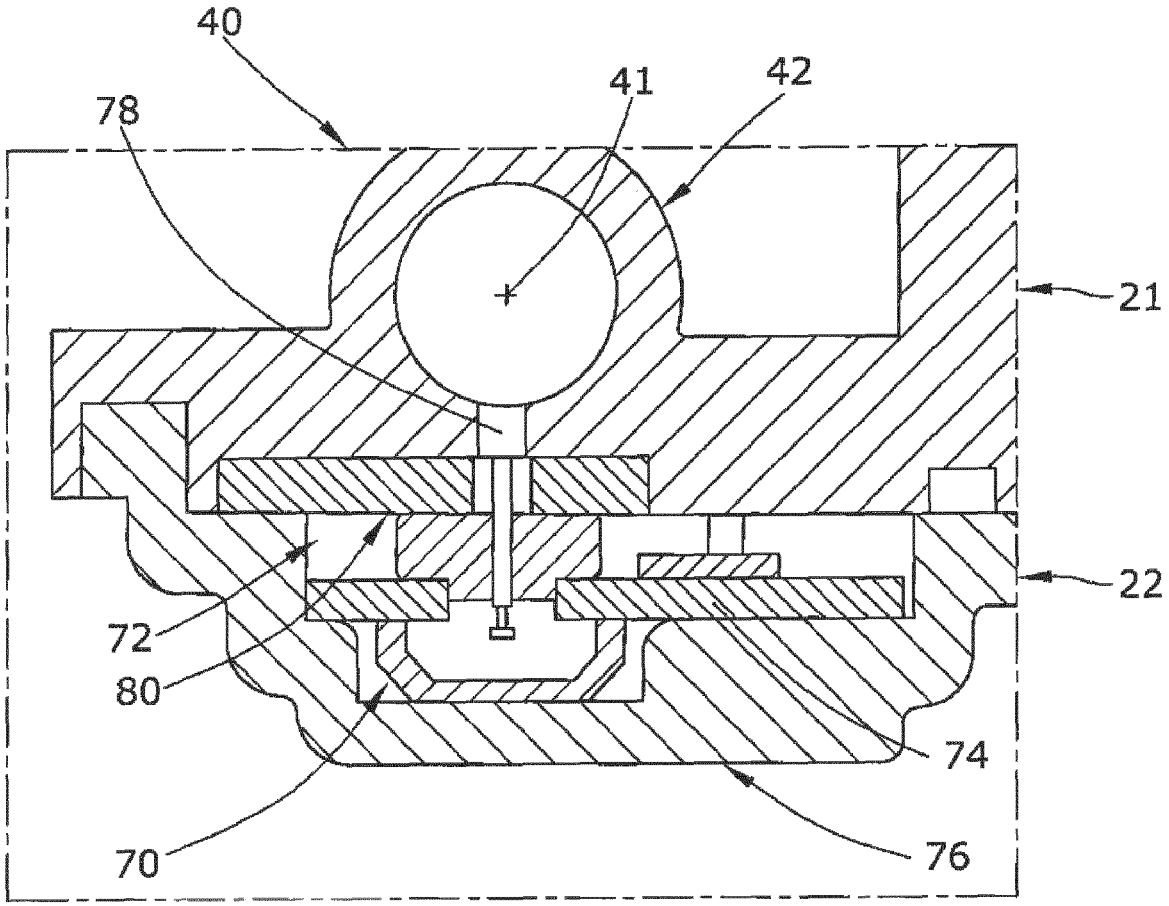
FIG. 4 shows a cross section of the pump outlet duct and the sensor chamber of the vapor pump of FIG. 1.
Figure 5:
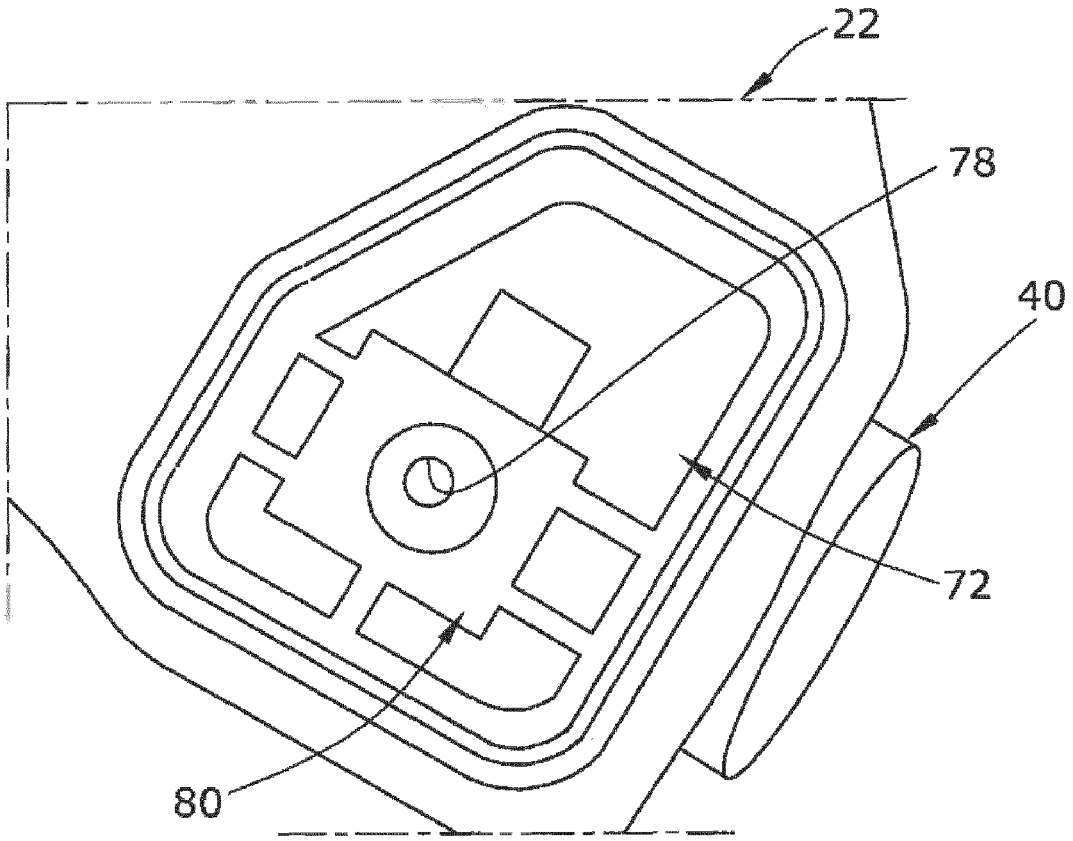
FIG. 5 shows a view into the sensor chamber provided at the motor housing part of the pump housing of the pump of FIG. 1.

As can be seen in FIGS. 4 and 5, an elastic sealing body 80 is provided between the pressure sensor 70 and the opening edge of the sensor opening 78 to provide a gas tight sealing.

The present invention is not limited to embodiments described herein; reference should be had to the appended claims.

What is claimed is:

1. An automotive vapor pump for pumping a pump gas comprising a fuel vapor, the automotive vapor pump comprising:

a pump inlet opening;

a pump outlet opening;

an outlet volute;

a pump outlet duct configured to be substantially tangential and to fluidically connect the outlet volute with the pump outlet opening;

a centrifugal pumping wheel configured to pump the pump gas from the pump inlet opening into the outlet volute, and subsequently into the pump outlet duct;

an electric motor configured to drive the centrifugal pumping wheel, the electric motor comprising at least one static motor coil, a magnetic rotor body, and a motor driving electronics which is configured to drive the at least one static motor coil;

an electric connector plug which comprises a contact pin, the electric connecter plug being configured to electrically connect the motor driving electronics with an external control unit;

an integrated pressure sensor configured to detect a fluidic pressure in the outlet volute or in the pump outlet duct;

a first integrated electric line; and a second integrated electric line, wherein, the integrated pressure sensor is electrically connected with the contact pin of the electric connector plug via the first integrated electric line, and the integrated pressure sensor is electrically connected with the motor driving electronics via the second integrated electric line.

2. The automotive vapor pump as recited in claim 1, wherein the automotive vapor pump is a purge pump.

3. The automotive vapor pump as recited in claim 1, wherein the integrated pressure sensor is arranged at the pump outlet duct between the outlet volute and the pump outlet opening.

4. The automotive vapor pump as recited in claim 1, wherein the electric connector plug and the integrated pressure sensor are arranged to axially overlap with each other.

5. The automotive vapor pump as recited in claim 1, wherein the pump outlet duct and the electric connector plug are arranged to axially overlap with each other.

6. The automotive vapor pump as recited in claim 1, further comprising:

a pump housing comprising a fluid housing part and a separate motor housing part, the fluid housing part being configured to define the pump inlet opening and the pump outlet duct, and the separate motor housing part comprising the electric motor, a sensor chamber, and being configured to substantially house the integrated pressure sensor.

7. The automotive vapor pump as recited in claim 6, wherein the sensor chamber is arranged axially between the pump outlet duct and the electric connector plug and is configured to house the integrated pressure sensor.

8. The automotive vapor pump as recited in claim 6, wherein the pump outlet duct comprises an outlet duct wall which comprises a sensor opening which is configured to fluidically connect an interior of the pump outlet duct with the sensor chamber.

9. The automotive vapor pump as recited in claim 8, wherein the sensor opening is provided at the fluid housing part.

10. An automotive vapor pump arrangement comprising:

a fuel tank;

a vapor absorption unit; and an automotive vapor pump as recited in claim 1 fluidically arranged between the vapor absorption unit and a vapor target, the automotive vapor pump being configured to pump a fuel vapor to the vapor target.

11. The automotive vapor pump arrangement as recited in claim 10, wherein the vapor target is an intake section of an internal combustion engine.

* * * * *